US010137472B2

(12) United States Patent
Ayers

(10) Patent No.: US 10,137,472 B2
(45) Date of Patent: Nov. 27, 2018

(54) DUAL PATTERN SHIM ASSEMBLY FOR USE IN CONJUNCTION WITH HOT MELT ADHESIVE DISPENSING SYSTEMS

(75) Inventor: Andrew S. Ayers, Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1643 days.

(21) Appl. No.: 12/073,374

(22) Filed: Mar. 5, 2008

(65) Prior Publication Data

US 2008/0245298 A1 Oct. 9, 2008

Related U.S. Application Data

(60) Provisional application No. 60/907,535, filed on Apr. 6, 2007.

(51) Int. Cl.
*B05C 5/00* (2006.01)
*B05C 5/02* (2006.01)

(52) U.S. Cl.
CPC ..... *B05C 5/0254* (2013.01); *B05C 5/025* (2013.01)

(58) Field of Classification Search
USPC ..... 239/551; 425/133.5, 382.4, 462
See application file for complete search history.

(56) References Cited

U.S. PATENT DOCUMENTS 3,448,183 A * 6/1969 Chisholm ..... 264/37.32
4,476,165 A * 10/1984 McIntyre ..... 427/258
4,774,109 A 9/1988 Hadzimihalis et al.
5,728,430 A * 3/1998 Sartor ..... B05C 5/0254 118/411
6,601,741 B2 8/2003 McGuffey
7,152,815 B2 12/2006 Harris et al.
2004/0256496 A1 12/2004 Harris et al.

FOREIGN PATENT DOCUMENTS

EP 0096453 12/1983
JP H03109672 U 11/1991
JP 11-226469 8/1999
JP 11226469 8/1999
(Continued)

OTHER PUBLICATIONS

English Translation for JP 2006015235.*
(Continued)

*Primary Examiner* — Charles Capozzi
(74) *Attorney, Agent, or Firm* — Levenfeld Pearlstein, LLC

(57) ABSTRACT

A dual pattern shim assembly, for use in conjunction with hot melt adhesive dispensing systems, permits various different overlapping or overlying deposition or application patterns, having different length dimensions, different width dimensions, different coating thicknesses, and different longitudinal positional locations or dispositions with respect to each other, to be achieved during a single pass of the underlying substrate with respect to the hot melt adhesive contact die applicator or head. In this manner, different or multiple adhesive deposition or application procedures are able to effectively be accomplished simultaneously so as to effectively simplify and shorten the overall assembly lines and production times required for the fabrication or manufacture of various different particular products.

19 Claims, 4 Drawing Sheets

(56) References Cited

FOREIGN PATENT DOCUMENTS

| | | | |
|---|---|---|---|
| JP | 2000506778 | A | 6/2000 |
| JP | 2003275651 | A | 9/2003 |
| JP | 2005028227 | A | 2/2005 |
| JP | 270704 | | 10/2005 |
| JP | 2005270704 | A | 10/2005 |
| JP | 015235 | | 1/2006 |
| JP | 2006015235 | A | 1/2006 |
| JP | 2006068708 | A | 3/2006 |

OTHER PUBLICATIONS

International Preliminary Report on Patentability and Written Opinion of the International Searching Authority in PCT/US08/058887, dated Oct. 6, 2009.

* cited by examiner

DUAL PATTERN SHIM ASSEMBLY FOR USE IN CONJUNCTION WITH HOT MELT ADHESIVE DISPENSING SYSTEMS

CROSS-REFERENCE TO RELATED PATENT APPLICATION

This patent application is related to, based upon, and effectively a utility patent application conversion from U.S. Provisional Patent Application Ser. No. 60/907,535, which was filed on Apr. 6, 2007, the filing date benefits of which are hereby incorporated by reference.

FIELD OF THE INVENTION

The present invention relates generally to hot melt adhesive dispensing or deposition systems, and more particularly to a new and improved dual pattern shim assembly for use in conjunction with a hot melt adhesive contact die applicator or head which enables multiple deposition coatings or patterns to be dispensed, discharged, and deposited or applied onto an underlying substrate in an overlying or overlapping manner during a single pass of the underlying substrate with respect to the hot melt adhesive contact die applicator or head. This shim apparatus or assembly therefore permits, for example, hot melt adhesive materials to be deposited onto the underlying substrate in accordance with multiple predetermined patterns at predetermined times during the deposition process or procedure dependent upon, for example, the structural requirements of the particular product being fabricated or manufactured so as to effectively enhance the fabrication or manufacturing capabilities of the overall product assembly line. In a similar manner, this shim apparatus or assembly effectively permits different or multiple adhesive deposition or application procedures to effectively be accomplished simultaneously so as to effectively simplify and shorten the overall assembly lines and production times required for the fabrication or manufacture of various different particular products.

BACKGROUND OF THE INVENTION

Very often in connection with the deposition of various materials or substances, such as, for example, hot melt adhesive material, onto an underlying substrate, it is desired to deposit or apply different types of adhesive materials, compositions, or the like, or adhesive coatings or materials, comprising different thickness dimensions or patterns, in an overlying or overlapping manner onto the underlying substrate. For example, depending upon the particular structural requirements of the particular product being fabricated or manufactured, the hot melt adhesive materials are required to be deposited upon the underlying substrate in accordance with predetermined patterns and at predetermined times during the deposition procedure or process. Such deposition techniques may theoretically be accomplished, for example, by means of a system employing two different contact die applicators, however, this has not in fact proven to be practically viable in view of the fact that when the second contact die applicator deposits the second adhesive, material, or coating onto the underlying substrate, the first material, adhesive, coating, or substance tends to be wiped off the underlying substrate. Accordingly, it has been contemplated that another mode for achieving such deposition techniques may be accomplished, for example, by means of a system wherein the first adhesive coating or substance is applied by means of a contact die applicator, however, the second adhesive coating or substance is applied by means of a spraying operation. However, this type of system is relatively complex in view of the fact that two different applicators must be utilized, both pneumatic and hydraulic systems need to be employed, and the actual handling, or relative movement of the substrate, with respect to the applicators, becomes relatively complicated.

A need therefore exists in the art for a new and improved dispensing system, in particular, for a hot melt adhesive dispensing system, wherein multiple different types of materials, substances, adhesives, coatings, or the like, or multiple different materials, adhesives, coatings or substances, comprising, for example, different thickness dimensions or patterns, can be deposited or applied in an overlying or overlapping manner onto an underlying substrate during a single pass of the underlying substrate with respect to the applicator or head. A need also exists in the art for a new and improved dispensing system, in particular, for a hot melt adhesive dispensing system, wherein the multiple different hot melt adhesive materials can be deposited upon the underlying substrate in accordance with predetermined patterns, and at predetermined times during the deposition procedure or process, depending upon the particular structural requirements of the particular product being fabricated or manufactured so as to effectively enhance the fabrication or manufacturing capabilities of the overall product assembly line. Still further, a need exists in the art for a new and improved dispensing system, in particular, for a hot melt adhesive dispensing system, wherein multiple different adhesive deposition or application procedures are permitted to effectively be accomplished simultaneously so as to effectively simplify and shorten the overall assembly line and production times required for the fabrication or manufacture of various different particular products.

SUMMARY OF THE INVENTION

The foregoing and other objectives are achieved in accordance with the teachings and principles of the present invention through the provision of a new and improved dual pattern shim assembly, for use in connection with a hot melt adhesive contact die applicator, which comprises a pair of pattern shims, each one having multiple deposition or applicator discharge ports, which are mounted upon or between a die adaptor and a die plate, and wherein further, a separator shim is interposed between the pair of pattern shims. At least a first set of hot melt adhesive supply paths is defined within the shim assembly and comprises at least a first set of hot melt adhesive flow channels formed within the die adaptor so as to effectively supply at least a first hot melt adhesive material to the deposition pattern ports of a first one of the pair of pattern shims, while at least a second set of hot melt adhesive supply paths is defined within the shim assembly and comprises a first set of through-holes or bores formed within the die adaptor, a second set of through-holes or bores formed within non-deposition portions of the first pattern shim, a third set of through-holes or bores formed within the separator shim, a fourth set of through-holes or bores formed within non-deposition portions of the second pattern shim, and at least a second set of flow channels formed within the die plate and fluidically connected to the deposition pattern portions of the second pattern shim.

Such a system therefore enables dual deposition coatings or patterns to be dispensed, discharged, and deposited or applied onto an underlying substrate in an overlying or overlapping manner as a result of a single pass of the underlying substrate with respect to the contact die applicator. Still further, as a result of the aforenoted structure of the shim assembly, multiple different hot melt adhesive materials can be deposited upon the underlying substrate in accordance with predetermined patterns, and at predetermined times during the deposition procedure or process, depending upon the particular structural requirements of the particular product being fabricated or manufactured so as to effectively enhance the fabrication or manufacturing capabilities of the overall product assembly line. Still further, different or multiple adhesive deposition or application procedures are permitted to effectively be accomplished simultaneously so as to effectively simplify and shorten the overall assembly line and production times required for the fabrication or manufacture of various different particular products.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

BRIEF DESCRIPTION OF THE PREFERRED EMBODIMENT

Figure 1:
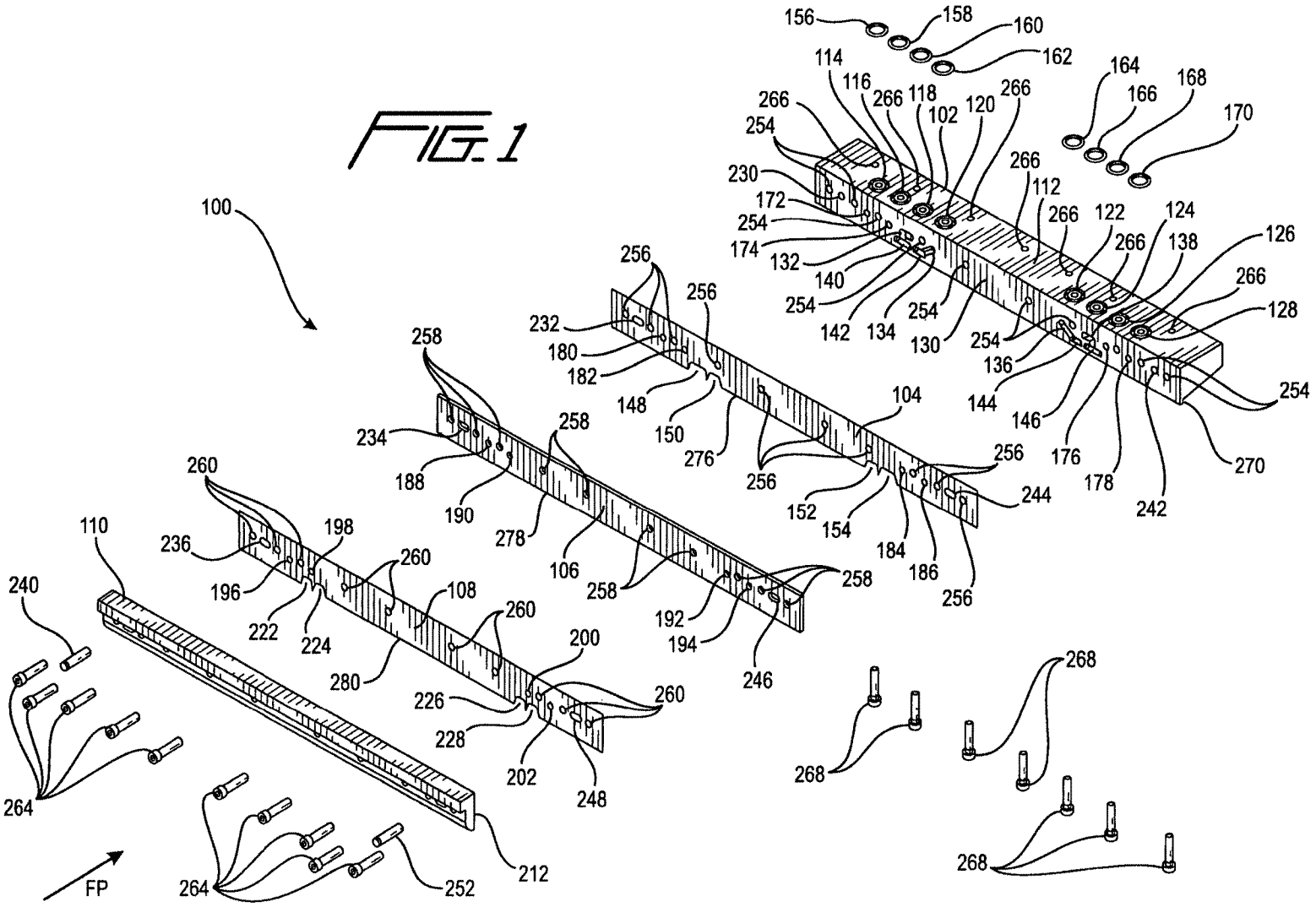
FIG. 1 is an exploded view of a new and improved dual pattern shim assembly, for use with a hot melt adhesive contact die applicator, as constructed in accordance with the principles and teachings of the present invention and showing the cooperative parts thereof.

Referring now to the drawings, and more particularly to FIGS. 1-6 thereof, a new and improved dual pattern shim assembly, for use in conjunction with, for example, a hot melt adhesive applicator or head, as constructed in accordance with the principles and teachings of the present invention, is disclosed and is generally indicated by the reference character 100. More particularly, as can probably be best seen from FIG. 1, it is seen that the new and improved dual pattern shim assembly 100, for use in conjunction with, for example, a hot melt adhesive applicator or head, and for depositing or applying multiple deposits or patterns onto an underlying substrate, comprises a die adaptor 102, a first pattern shim 104, a separation shim 106, a second pattern shim 108, and a die plate 110, wherein the underlying substrate will be movable relative to the new and improved dual pattern shim assembly 100 along a flow path FP. For ease of understanding the present invention, and the operation thereof, the new and improved dual pattern shim assembly 100 will be described as if two different types of adhesives, coatings, substances, or materials are being conducted through and discharged from the new and improved dual pattern shim assembly 100 so as to be deposited or applied onto the underlying substrate, however, it is to be appreciated that the two different types of adhesives, coatings, substances, or materials can actually comprise multiple different types of adhesives, coatings, substances, or materials, or the same adhesive, coating, substance, or material but may be differentiated from each other in that the two different adhesives, coatings, substances, or materials may comprise or be characterized by different thickness dimensions or different patterns, all as will be explained more fully hereinafter.

Figure 2:
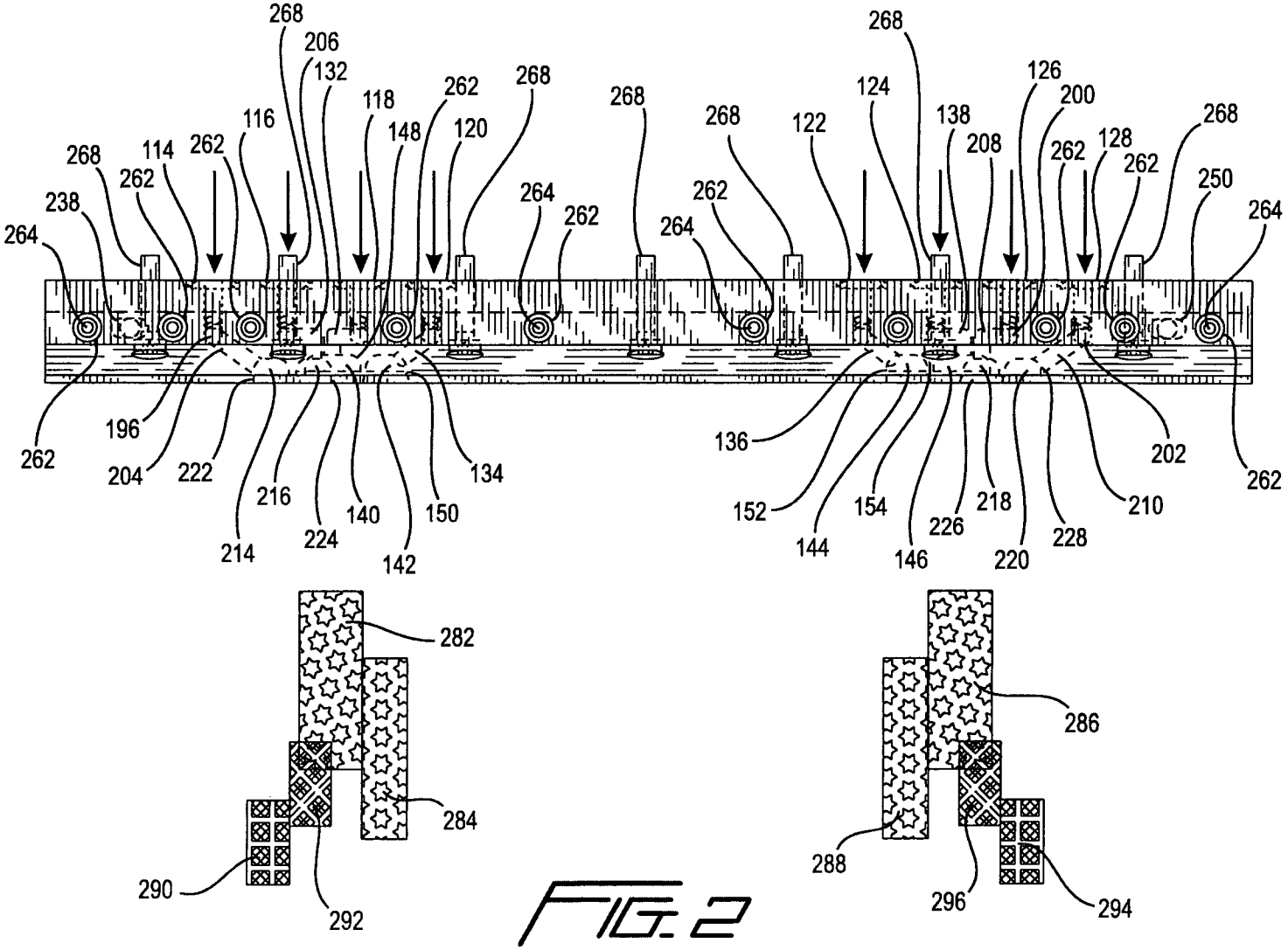
FIG. 2 is a front elevational view, partially in cross-section, of the assembled dual pattern shim assembly as disclosed within FIG. 1.
Figure 3:
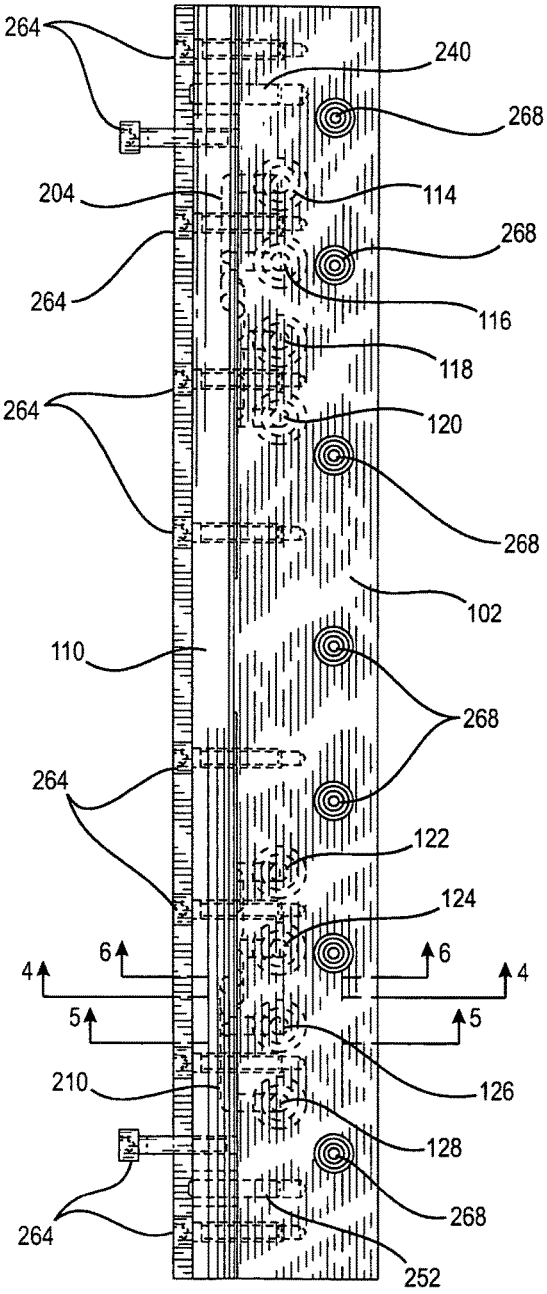
FIG. 3 is a top plan view, partially in cross-section, of the assembled dual pattern shim assembly as disclosed within FIGS. 1 and 2.
Figure 4:
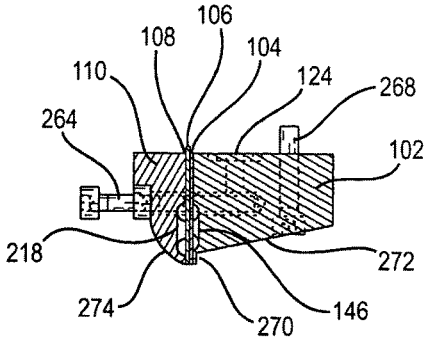
FIG. 4 is a cross-sectional view of the assembled dual pattern shim assembly as disclosed within FIG. 3 as taken along the lines 4-4 of FIG. 3.
Figure 5:
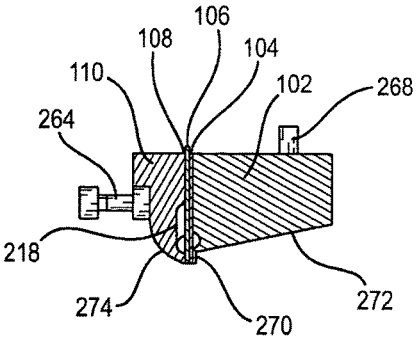
FIG. 5 is a cross-sectional view of the assembled dual pattern shim assembly as disclosed within FIG. 3 as taken along the lines 5-5 of FIG. 3.
Figure 6:
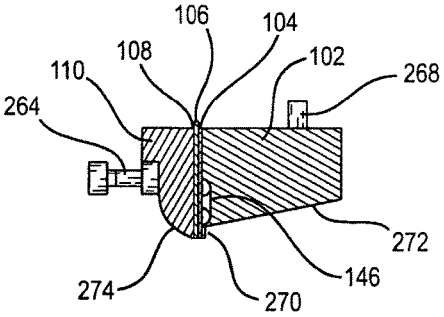
FIG. 6 is a cross-sectional view of the assembled dual pattern shim assembly as disclosed within FIG. 3 as taken along the lines 6-6 of FIG. 3.

With reference continuing to be made to FIGS. 1-6, but in particular to FIG. 1 for clarity, it is seen that the die adaptor 102 has a substantially trapezoidal cross-sectional configuration, and that the upper surface portion 112 of the die adaptor 102 is provided with, for example, eight fluid inlet ports 114,116,118,120,122,124,126, 128 for providing the die adaptor 102 with, for example, eight separate supplies of, for example, hot melt adhesive materials which are supplied thereto, for example, by means of a suitable number of pumps, not shown, although the fluid flows from the pumps are schematically illustrated by inlet arrows within FIG. 2. In accordance with the particular exemplary arrangement of the assembly 100 of the present invention, to which this disclosure is directed, the eight fluid inlet ports 114,116,118, 120,122,124,126,128 are disposed within two laterally or transversely spaced sets of fluid inlet ports with each set of fluid inlet ports comprising four fluid inlet ports, and four pumps, not shown, are utilized to respectively supply two different fluids, such as, for example, two different hot melt adhesive materials, to the eight fluid inlet ports 114,116,118, 120,122,124, 126,128, although it is to be noted that, in accordance with other possible arrangements or embodiments which may be constructed in accordance with the general principles and teachings of the present invention, a larger or smaller number of pumps may in fact be provided in conjunction with the assembly 100.

For example, only two pumps, not shown, may be utilized whereby each pump will supply a particular one of two fluids or hot melt adhesive materials to four of the eight fluid inlet ports 114,116,118,120,122,124,126,128, or alternatively, eight different pumps, not shown, may be utilized whereby each pump will directly supply a respective one of eight different fluids or hot melt adhesive materials to the eight fluid inlet ports 114,116,118,120,122,124,126,128. Other combinations and permutations comprising the number of pumps, number of different fluids, materials, substances, or the like, being supplied to particular numbers of the fluid inlet ports 114,116,118,120,122,124,126,128, are also of course possible so as to achieve the deposition or application of different fluids, different patterns, different coating thicknesses, and the like, onto the underlying substrate in accordance with particular or predeterminedly desirable patterns as required for particular or different products being fabricated or manufactured.

More particularly, with reference still being made primarily to FIG. 1, a first one of the aforenoted two pumps, not shown, will supply a first one of the two different hot melt adhesive materials to the fluid inlet ports 118, 120,122,124 defined within the upper surface portion 112 of the die adaptor 102, and it is seen that the forwardly facing surface portion 130 of the die adaptor 102 is provided with a plurality of flow channels 132,134,136,138 which are adapted to be respectively fluidically connected, at the upstream end portions thereof, to the fluid inlet ports 118, 120,122,124. In turn, downstream end portions of the plurality of flow channels 132,134,136,138 are respectively fluidically connected to a plurality of fluid discharge ports 140,142,144, 146 which are also defined within the forwardly facing surface portion 130 of the die adaptor 102, and still further, the plurality of fluid discharge ports 140, 142,144,146 are adapted to be respectively fluidically connected to a plurality of first fluid deposition or application ports 148,150, 152,154 which are defined within the lower edge portion of the first pattern shim 104 and which will therefore deposit or apply the first fluid, or the first one of the two different hot melt adhesive materials, onto the underlying substrate in accordance with a predetermined pattern, thickness coating, or the like. It is also noted that a plurality of O-ring members 156,158,160,162,164, 166,168,170 are adapted to be respectively operatively associated with the plurality of fluid in-let ports 114,116,118,120,122,124,126, 128 so as to provide desired fluid sealing in connection therewith.

Continuing further, it is also seen that forwardly facing surface portion 130 of the die adaptor 102 is also provided with a plurality of flow channels 172,174,176,178 which are adapted to be respectively fluidically connected, at the upstream end portions thereof, to the fluid inlet ports 114, 116,126,128, and, in turn, the downstream end portions of the plurality of flow channels 172,174,176,178 are adapted to be respectively fluidically connected to a first set of through-bores or holes 180,182,184,186 which are defined within the first pattern shim 104. It is similarly seen that the separation shim 106 is likewise provided with a second set of holes or through-bores 188,190,192,194 which are adapted to be respectively fluidically connected to the first set of through-bores or holes 180,182,184,186 defined within the first pattern shim 104. Still further, a third set of through-bores or holes 196,198,200,202 are defined within the second pattern shim 108 and are adapted to be respectively fluidically connected to the second set of through-bores or holes 188,190,192,194 which are defined within the separation shim 106. It is lastly seen that a plurality of flow channels 204,206,208,210 are defined upon or within the rearwardly facing surface portion 212 of the die plate 110, as can best be seen from FIG. 2, and that the plurality of flow channels 204,206,208,210 are adapted to be respectively fluidically connected, at the upstream end portions thereof, to the third set of through-bores or holes 196,198,200,202 which are defined within the second pattern shim 108 so as to receive the second fluid therefrom, while the downstream end portions of the flow channels 204,206,208,210 are adapted to be respectively fluidically connected to a plurality of fluid discharge ports 214,216,218,220, which are also defined within the rearwardly facing surface portion 212 of the die plate 110, so as to supply the second fluid thereto. Still further, the plurality of fluid discharge ports 214,216, 218,220 are adapted to be respectively fluidically connected to a plurality of second fluid deposition or application ports 222,224, 226,228 which are defined within the lower edge portion of the second pattern shim 108 and which will therefore serve to deposit or apply the second fluid, or the second one of the two different hot melt adhesive materials, onto the underlying substrate in accordance with a predetermined pattern, coating thickness, or the like.

With reference now being specifically made to FIGS. 3-6, in addition to FIGS. 1 and 2, the assembling procedure of the new and improved dual pattern shim assembly 100, as well as the mounting of the new and improved dual pattern shim assembly onto a hot melt adhesive applicator or head, will now be described. More particularly, it is seen that in order to assemble together the various components comprising the new and improved dual pattern shim assembly 100 of the present invention, left side portions of the die adaptor 102, the first pattern shim 104, the separation shim 106, the second pattern shim 108, and the die plate 110 are respectively provided with first bores or apertures 230,232, 234, 236,238 for accommodating a first dowel pin 240 which is adapted to be inserted through the aforenoted bores or apertures 230,232,234,236,238 so as to effectively align the left side portions of the die adaptor 102, the first pattern shim 104, the separation shim 106, the second pattern shim 108, and the die plate 110 together. In a similar manner, right side portions of the die adaptor 102, the first pattern shim 104, the separation shim 106, the second pattern shim 108, and the die plate 110 are respectively provided with second bores or apertures 242,244,246,248,250 for accommodating a second dowel pin 252 which is adapted to be inserted through the aforenoted bores or apertures 242,244,246,248,250 so as to effectively align the right side portions of the die adaptor 102, the first pattern shim 104, the separation shim 106, the second pattern shim 108, and the die plate 110 together.

In this manner, as a result of the disposition of the first and second dowel pins 240,252 within the respective apertures or holes 230,232,234,236,238 and 242,244,246,248, 250, all of the structural components comprising the new and improved dual pattern shim assembly 100, that is, the die adaptor 102, the first pattern shim 104, the separation shim 106, the second pattern shim 108, and the die plate 110, are properly aligned with respect to each other and ready to be fixedly assembled together. Accordingly, it is seen that each one of the die adaptor 102, the first pattern shim 104, the separation shim 106, the second pattern shim 108, and the die plate 110 components is also respectively provided with a plurality of apertures or bores, such as, for example, ten apertures of bores, 254,256,258,260,262 which are disposed within a horizontal array and which are adapted to respectively receive therethrough a plurality of suitable bolt fasteners, that is, ten bolt fasteners 264 so as to in fact fixedly secure the die adaptor 102, the first pattern shim 104, the separation shim 106, the second pattern shim 108, and the die plate 110 together in order to form the new and improved dual pattern shim assembly 100. Lastly, it is seen still further that the die adaptor 102 is provided with a plurality of vertically oriented bores, such as, for example, seven bores 266, within which a plurality of bolt fasteners, such as, for example, seven bolt fasteners 268, are adapted to be inserted for threaded engagement within an undersurface portion of the hot melt adhesive applicator or head, not shown, in order to fixedly mount the new and improved dual pattern shim assembly 100 thereon.

Having described substantially all of the structural components comprising the new and improved dual pattern shim assembly 100 of the present invention, a brief operation of the same will now be described along with some unique operative features thereof. As can best be appreciated from any one of FIGS. 4-6, it is noted that the bottom edge portion 270 of the forwardly facing surface portion 130 of the trapezoidal-shaped die adaptor 102 projects downwardly beneath, for example, the lower or inclined bottom surface portion 272 of the die adaptor 102 so as to form what is known as a knife edge. In addition, it is also seen that the rearwardly facing or extending bottom edge portion of the die plate 110 terminates in an arcuately shaped portion 274 which is known as an eagle beak, and that the first pattern shim 104, the separation shim 106, and the second pattern shim 108 are effectively sandwiched between the die adaptor 102 and the die plate 110 such that the respective lower edge portions 276,278,280 of the first pattern shim 104, the separation shim 106, and the second pattern shim 108 are effectively aligned with, or disposed at the same elevational level as, the knife edge 270 of the die adaptor 102 and the terminal edge portion of the eagle beak 274. Still further, the separation shim 106 is provided with a relatively small thickness dimension which not only permits the lower edge portions 276,280 of the first and second pattern shims 104,108 to be physically located relatively close to each other, but in addition, to permit both of the lower edge portions 276,280 of the first and second pattern shims 104,108 to also be physically located relatively close to the knife edge 270 of the die adaptor 102. In this manner, as will be explained even more fully hereinafter, such a composite assembly defines a sharply edged structure which permits the desired patterns to in fact be deposited or applied onto the underlying substrate as desirably crisp, sharp, and clean images when in fact, for example, hot melt adhesive material is dispensed or discharged from, and deposited or applied onto the underlying substrate, by means of either one of the pattern shims 104,108.

Figure 7:
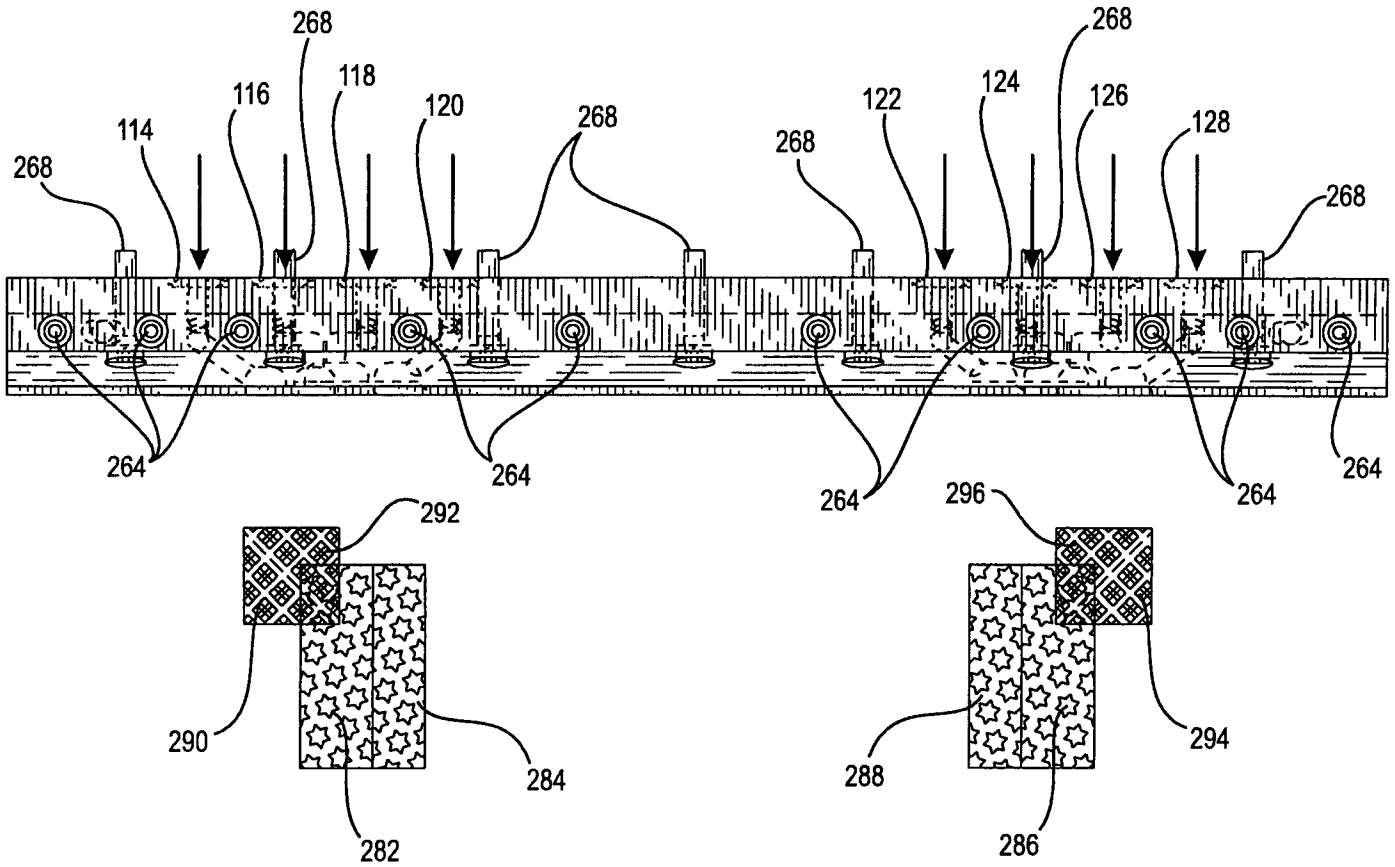
FIG. 7 is a front elevational view of the assembled dual pattern shim assembly, similar to that disclosed within FIG. 2, showing, however, the generation of different patterns as a result of the particular operation of the dual pattern shim assembly of the present invention.

Continuing further, and as can be appreciated from a comparison of FIGS. 2 and 7, it is to be appreciated that as a result of the aforenoted new and improved dual pattern shim assembly 100 as constructed in accordance with the principles and teachings of the present invention, different deposition or application patterns, different deposition or application patterns having different width dimensions, and different deposition or application patterns, having overlapping or overlying sections or portions, can be achieved. For example, as can best be seen or appreciated from FIGS. 1 and 2, a first deposition or application pattern 282 comprising, for example, a first hot melt adhesive material, is deposited or applied onto the underlying substrate by means of the fluid deposition port 148 defined within the lower edge portion 276 of the first pattern shim 104, and it is seen that such first deposition or application pattern 282 has predetermined length and width dimensions. In addition, this first deposition or application pattern 282 preferably has a first predetermined thickness dimension.

In a similar manner, a second deposition or application pattern 284 comprising, for example, the same hot melt adhesive material as that utilized in forming the first deposition or application pattern 282, is deposited or applied onto the underlying substrate by means of the fluid deposition port 150 which is also defined within the lower edge portion 276 of the first pattern shim 104, and it is seen that such second deposition or application pattern 284 has a predetermined length dimension which is substantially the same as that of the first deposition or application pattern 284, however, it is also appreciated that the second deposition or application pattern 284 is effectively longitudinally offset with respect to the first deposition or application pattern 282 as a result of the suitably timed operation of, for example, the dispensing valving structure, not shown, disposed within the applicator or head, also not shown. In addition, it is seen that the width dimension of the second deposition or application pattern 284 is somewhat smaller or narrower than that of the first deposition or application pattern 282 as determined, for example, by the relative width dimensions of the fluid depositions ports 148,150. Furthermore, this second deposition or application pattern 284 preferably has a predetermined thickness dimension which is substantially the same as that of the first deposition or application pattern 282. Still yet further, third and fourth deposition or application patterns 286,288, respectively similar to the first and second deposition or application patterns 282,284, are formed by the corresponding fluid deposition ports 154,152 which are likewise defined within the lower edge portion 276 of the first pattern shim 104.

Continuing still further, it is similarly seen that a fifth deposition or application pattern 290 comprising, for example, a second hot melt adhesive material, is deposited or applied onto the underlying substrate by means of the fluid deposition port 222 defined within the lower edge portion 280 of the second pattern shim 108, and it is seen that such fifth deposition or application pattern 290 also has predetermined length and width dimensions. In addition, this fifth deposition or application pattern 290 preferably has a second predetermined thickness dimension which may be greater than or less than that of, for example, any one of the deposition or application patterns 282,284,286,288. In a similar manner, a sixth deposition or application pattern 292 comprising, for example, the same second hot melt adhesive material as that utilized in forming the fifth deposition or application pattern 290, is deposited or applied onto the underlying substrate by means of the fluid deposition port 224 which is also defined within the lower edge portion 280 of the second pattern shim 108, and it is seen that such second deposition or application pattern 292 has predetermined length and width dimensions which are substantially the same as those of the fifth deposition or application pattern 290, however, it is also appreciated that the sixth deposition or application pattern 292 is effectively longitudinally offset with respect to the fifth deposition or application pattern 290 as a result of the suitably timed operation of, for example, the dispensing valving structure, not shown, disposed within the applicator or head, also not shown, whereby the particular first and second hot melt adhesive materials are dispensed at predetermined times relative to the movement of the underlying substrate along the flow path FP.

In addition, this sixth deposition or application pattern 292 preferably has a predetermined thickness dimension which is substantially the same as that of the fifth deposition or application pattern 290. Still further, seventh and eighth deposition or application patterns 294,296, respectively similar to the fifth and sixth deposition or application patterns 290,292, are formed by the corresponding fluid deposition ports 228,226 which are likewise defined within the lower edge portion 280 of the second pattern shim 108. Still yet further, it is also seen, for example, that a trailing edge portion of the first deposition or application pattern 282 is overlapped by means of a leading edge portion of the sixth deposition or application pattern 292, and similarly with respect to the trailing edge portion of the third deposition or application pattern 286 which is overlapped by means of the leading edge portion of the eighth deposition or application pattern 296. Again, this is achieved as a result of, for example, the particular timing of the dispensing valve structure, not shown, disposed within the applicator or head, also not shown, whereby the particular first and second hot melt adhesive materials are dispensed at predetermined times relative to the movement of the underlying substrate along the flow path FP.

In addition, it is to be appreciated that the overlapped deposition or application of the two different hot melt adhesive materials atop one another is also achieved as a result of the unique contact or engagement of the entire aforenoted new and improved dual pattern shim assembly 100 of the present invention, as comprising, for example, the knife edge structure 270 of the die adaptor 102, the lower edge portion 276 of the first pattern shim 104, the lower edge portion 278 of the separation shim 106, the lower edge portion 280 of the second pattern shim 108, and the terminal edge section of the eagle beak portion 274 of the die plate 110, with the underlying substrate. In particular, as such assembly 100 contacts or engages the underlying substrate, and assuming that, for example, the first deposition or application pattern 282 is in fact the first deposition or application pattern to in fact be deposited or applied onto the underlying substrate from the first pattern shim 104, the underlying substrate will, in effect, be slightly indented or depressed, not only as a result of the contact or engagement of the underlying substrate by means of the dual pattern shim assembly 100, but in addition, as a result of the pressure of the holt melt adhesive material being dispensed or discharged from, for example, the first pattern shim 104. Subsequently, and in a similar manner, when the sixth deposition or application pattern 292 of the hot melt adhesive material is to be deposited or applied onto the underlying substrate such that the leading edge portion of the sixth deposition or application pattern 292 is disposed atop the trailing edge portion of the first deposition or application pattern 282 in an overlying or overlapping manner, by means the second pattern shim 108, then again, as such dual pattern shim assembly 100 contacts or engages the underlying substrate, the underlying substrate will, in effect, again be slightly indented or depressed, not only as a result of the contact or engagement of the underlying substrate by means of the dual pattern shim assembly 100, but in addition, as a result of the pressure of the holt melt adhesive material being dispensed or discharged from, for example, the second pattern shim 108. Accordingly, the hot melt adhesive, being dispensed or discharged from the second pattern shim 108, will in fact be able to be deposited or applied onto the underlying substrate within such secondary indented or depressed region by means of the second pattern shim 108, and atop the first deposition or application pattern 282 in an overlying or overlapping manner, so as not to disturb or otherwise adversely affect the previously applied first deposition or application pattern 282.

As can best be appreciated from FIG. 7, it is also seen that alternative or converse deposition or application patterns 282,284,286,288,290,292,294,296, with respect to the deposition or application patterns 282,284,286,288, 290,292,294, 296 as disclosed within, for example, FIG. 2, can likewise be achieved. More particularly, it is seen, for example, that not only are the deposition or application patterns 282,284, or 286,288, or 290,292, or 294,296 no longer longitudinally offset with respect to each other, but in accordance with the particular, overall deposition process or procedure comprising the deposition or application of the deposition or application patterns 282,284,286,288,290,292,294, 296 onto the underlying substrate, it is seen that in accordance with such deposition or application patterns as illustrated within FIG. 7, the trailing edge portion of the sixth deposition or application pattern 292 is now effectively overlapped by means of the leading edge portion of the first deposition or application pattern 282, and similarly with respect to the trailing edge portion of the eighth deposition or application pattern 296 being overlapped by means of the leading edge portion of the third deposition or application pattern 286. With the principles and teachings of the present invention, various different overlapping or overlying deposition or application patterns, having different length dimensions, width dimensions, coating thicknesses, relative longitudinal positional locations or dispositions, and the like, can be achieved by means of the new and improved dual pattern shim assembly 100 of the present invention.

In addition, it is to be noted and emphasized that, regardless of which patterns 282,284,286,288,290,292,294,296 are deposited or applied onto the underlying substrate, and regardless of the order in which the various patterns 282, 284,286,288,290,292,294,296 are deposited or applied onto the underlying substrate, the successful deposition or application of the patterns 282,284,286,288,290,292,294,296 onto the underlying substrate is achieved in accordance with, or as a result of, the aforenoted principles and teachings of the present invention. However, it is to be further noted that several other factors also come into play in connection with the deposition or application of the two hot melt adhesive materials onto the underlying substrate in order to in fact successfully achieve the aforenoted multiple depositions or patterns 282,284,286,288,290,292,294,296 upon the underlying substrate. For example, the provision of the separation shim 106, as having its relatively thin or small thickness dimension, has been noted as being important in that the same not only permits the first and second pattern shims 104,108 to be disposed extremely close to each other, but in addition, permits the pattern shims 104,108 to be disposed extremely close to the knife edge 270 of the die adaptor 102.

If the thickness dimension of the separation shim 106 is in fact too large, then the deposition of the first hot melt adhesive material from, for example, the first pattern shim 104, will be distorted, and will not be cleanly or crisply defined, because the relatively wide separation shim 106 will, in effect, tend to enhance the dwell time or deposition time of the deposition of the hot melt adhesive material being dispensed by the first pattern shim 104 whereby the pattern of such hot melt adhesive material will effectively be distorted. Conversely, if the thickness dimension of the separation shim 106 is in fact too thin, then the deposition pattern of the hot melt adhesive material being dispensed from the second pattern shim 108 will, in effect, be distorted because sufficient time for providing the aforenoted indenting or depression, into which the second deposition or application of the hot melt adhesive material from, for example, the second pattern shim 108, will not in fact have been able to have been effectuated. Therefore, instead of the hot melt adhesive material, being dispensed from the second pattern shim 108 in a truly overlapping manner with respect to the hot melt adhesive material that was dispensed from the first pattern shim 104, the hot melt adhesive material, being dispensed from the second pattern shim 108, will, in effect, commingle with the hot melt adhesive material previously deposited onto the underlying substrate from the first pattern shim 104. Therefore, the provision of the separation shim 106, having the correct thickness dimension, along with other operational or dispensing factors, such as, for example, the particular hot melt adhesive material being dispensed, its viscosity properties, the pressure of the hot melt adhesive material being dispensed, all affect the successful deposition or application of the particular patterns onto the underlying substrate.

Thus, it may be seen that in accordance with the principles and teachings of the present invention, there has been provided a new and improved dual pattern shim assembly, for use in conjunction with hot melt adhesive dispensing systems, wherein various different overlapping or overlying deposition or application patterns, having different length dimensions, different width dimensions, different coating thicknesses, different longitudinal positional locations or dispositions with respect to each other, and the like, can be achieved by means of the new and improved dual pattern shim assembly of the present invention during a single pass of the underlying substrate with respect to the hot melt adhesive contact die applicator or head. In this manner, different or multiple adhesive deposition or application procedures are able to effectively be accomplished simultaneously so as to effectively simplify and shorten the overall assembly lines and production times required for the fabrication or manufacture of various different particular products.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A hot melt adhesive dispensing system, comprising:

an underlying substrate; and a dual pattern shim assembly comprising:

a first pattern shim having a first lower edge in which a plurality of first fluid application ports are formed, wherein the first pattern shim deposits a first hot melt adhesive material onto the underlying substrate in a first material pattern, the first material pattern comprising a plurality of first deposition patterns, each first deposition pattern deposited onto the underlying substrate from a respective first fluid application port of the plurality of first fluid application ports;

a second pattern shim having a second lower edge in which a plurality of second fluid application ports are formed, wherein the second pattern shim deposits a second hot melt adhesive material onto the underlying substrate in a second material pattern, the second material pattern comprising a plurality of second deposition patterns, each second deposition pattern deposited onto the underlying substrate from a respective second fluid application port;

a separation shim interposed between the first and second pattern shims for separating the first and second pattern shims from each other, the separation shim having an intermediate lower edge disposed between the first lower edge and the second lower edge;

a die plate disposed adjacent to the second pattern shim, the die plate having a rearwardly facing bottom edge terminating in an arcuately shaped portion; and a die adaptor for receiving the first hot melt adhesive material in a plurality of first inlet ports from a source of the first hot melt adhesive material and the second hot melt adhesive material in a plurality of second inlet ports from a source of the second hot melt adhesive material, wherein the die adaptor defines a housing having an undersurface portion, a vertical front wall portion which has first fluid outlet ports for discharging the first hot melt adhesive material and second fluid outlet ports for discharging the second hot melt adhesive material defined within the vertical front wall portion of the die adaptor, and a knife edge portion extending vertically downwardly within a vertical plane from the vertical front wall portion of the die adaptor such that the knife edge portion is disposed beneath the undersurface portion of the die adaptor, wherein the vertical front wall portion of the die adaptor, the first and second fluid outlet ports, and the knife edge portion are substantially coplanar within a vertical plane, wherein the first pattern shim is disposed in abutment with the vertical front wall portion of the die adaptor and the knife edge portion of the die adaptor and is configured to receive the first hot melt adhesive material from the die adaptor, wherein the second pattern shim is configured to receive the second hot melt adhesive material from the die adaptor through the first pattern shim and the separation shim, wherein the first and second pattern shims, and the separation shim, as an assembly, are disposed immediately adjacent to the knife edge portion of the die adaptor such that the first and second hot melt adhesive materials are deposited onto the underlying substrate in an overlapping pattern relative to one another wherein at least one of a first deposition pattern of the plurality of first deposition patterns and a second deposition pattern of the plurality of second deposition patterns overlaps at least one of the other first deposition pattern and second deposition pattern, wherein a first flow path for the first hot melt adhesive material to be deposited onto the underlying substrate in the first material pattern by the first pattern shim is defined from the die adaptor to the first pattern shim, wherein a second flow path for the second hot melt adhesive material to be deposited onto the underlying substrate as the second material pattern by the second pattern shim is defined from the die adaptor, through the first pattern shim, through the separation shim, through the second pattern shim, to the die plate, and back to the second pattern shim, wherein the first hot melt adhesive material is different than the second hot melt adhesive material, wherein the underlying substrate is configured for movement along a path below the dual shim pattern assembly, wherein the knife edge portion, the first lower edge, the intermediate lower edge, the second lower edge and a terminal edge of the arcuately shaped portion are disposed at a same elevational level, and wherein the underlying substrate contacts the dual pattern shim assembly such that the underlying substrate is depressed by contact with the dual pattern shim assembly and one or more of the first hot melt adhesive material and the second hot melt adhesive material being deposited from the dual pattern shim assembly.

2. The hot melt adhesive dispensing system as set forth in claim 1, wherein:

the knife edge portion of the die adaptor is provided for defining the deposition of the first and second material patterns onto the underlying substrate without the first and second material patterns disturbing and adversely affecting each other.

3. The hot melt adhesive dispensing system as set forth in claim 1, wherein:

the first and second pattern shims are disposed upon the same side of the knife edge portion of the die adaptor.

4. The hot melt adhesive dispensing system as set forth in claim 1, wherein:

the die plate is disposed upon a first side of the second pattern shim while the separation shim is disposed upon a second opposite side of the second pattern shim.

5. The hot melt adhesive dispensing system as set forth in claim 1, further comprising a dispensing valve structure whereby the first and second hot melt adhesive materials are dispensed at predetermined times relative to movement of the underlying substrate in response to timed operation of the dispensing valve structure.

6. The hot melt adhesive dispensing system as set forth in claim 5, wherein at least one first fluid application port and at least one second fluid application port are positioned relative to one another in a width direction of the dual pattern shim assembly such that one of a first deposition pattern of the first hot melt adhesive material and a second deposition pattern of the second hot melt adhesive material overlaps the other of the first deposition pattern and the second deposition pattern in the width direction.

7. The hot melt adhesive dispensing system as set forth in claim 6, wherein:

in response to the timed operation of the dispensing valve structure, a leading edge portion of the second deposition pattern of the second hot melt adhesive material overlaps a trailing edge portion of the first deposition pattern of the first hot melt adhesive material.

8. The hot melt adhesive dispensing system as set forth in claim 6, wherein:

in response to the timed operation of the dispensing valve structure, a leading edge portion of the first deposition pattern of the first hot melt adhesive material overlaps a trailing edge portion of the second deposition pattern of the second hot melt adhesive material.

9. A dual pattern shim assembly comprising:

a die adaptor having a first plurality of fluid inlet ports, a first plurality of fluid discharge ports, a second plurality of fluid inlet ports and a second plurality of fluid discharge ports, wherein a first fluid is received in the first plurality of inlet ports and discharged from the first plurality of discharge ports, and a second fluid, different from the first fluid, is received in the second plurality of inlet ports and is discharged from the second plurality of discharge ports;

a first pattern shim fluidically connected to the die adaptor and having a first plurality of fluid application ports disposed along a width direction and a first plurality of through bores;

a second pattern shim fluidically connected to the die adaptor and having a second plurality of fluid application ports disposed along the width direction and a second plurality of through bores;

a separator shim positioned between the first pattern shim and the second pattern shim, the separator shim having a third plurality of through bores and a thickness so as to space apart the first pattern shim from the second pattern shim by a predetermined distance;

a die plate;

a first flow path defined in the first pattern shim by the first plurality of fluid application ports configured to receive the first fluid from the die adaptor; and a second flow path defined by the first plurality of through bores in the first pattern shim, the third plurality of through bores in the separator shim, the second plurality of through bores in the second pattern shim and a plurality of flow channels in the die plate, fluidically connecting the die adaptor to the second plurality of application ports, the second flow path configured to receive the second fluid from the die adaptor, wherein outermost fluid application ports of the first plurality of fluid application ports are spaced apart by a first distance in the width direction, the first distance extending across a center of the of the first pattern shim in the width direction, and outermost fluid application ports of the second plurality of fluid application ports are spaced apart by a second distance in the width direction, different than the first distance, the second distance extending across a center of the second pattern shim in the width direction, so that the outermost fluid application ports of the first plurality of fluid application ports do not overlap, in the width direction, the outermost fluid application ports of the second plurality of fluid application ports.

10. The dual pattern shim assembly as set forth in claim 9, wherein:

the separator shim has a greater thickness than the first pattern shim.

11. The dual pattern shim assembly of claim 9, wherein innermost fluid application ports of the first plurality of fluid application ports are spaced apart by a third distance in the width direction and innermost fluid application ports of the second plurality of fluid application ports are spaced apart by a fourth distance in the width direction, different than the third distance, so that the innermost fluid application ports of the first plurality of fluid application ports do not overlap, in the width direction, the innermost fluid application ports of the second plurality of fluid application ports.

12. The dual pattern shim assembly claim 11, wherein the outermost fluid application ports of the first plurality of fluid applications overlap, in the width direction, the innermost fluid application ports of the second plurality of fluid application ports.

13. A dual pattern shim assembly for use in conjunction with hot melt adhesive dispensing systems for depositing a first hot melt adhesive material and a second hot melt adhesive material onto an underlying substrate in accordance with predetermined first and second material patterns, respectively, comprising:

a die adaptor having an upper surface portion, a forwardly facing surface portion, a lower surface portion, and a knife edge portion projecting downwardly beneath the lower surface portion from the forwardly facing surface portion, the die adaptor comprising:

a first set of fluid inlet ports provided in the upper surface portion and receiving the first hot melt adhesive material from a first hot melt adhesive material supply;

a first set of flow channels provided in the forwardly facing surface portion, wherein each flow channel of the first set of flow channels is fluidically connected to a respective fluid inlet port of the first set of fluid inlet ports;

a plurality of fluid discharge ports defined in the forwardly facing surface portion through which the first hot melt adhesive material is discharged, wherein each fluid discharge port is fluidically connected to a respective flow channel of the first set of flow channels;

a second set of fluid inlet ports provided in the upper surface portion and receiving the second hot melt adhesive material from a second hot melt adhesive material supply; and a second set of flow channels provided in the forwardly facing surface portion, each flow channel of the second set of flow channels having a downstream end through which the second hot melt adhesive material is discharged, wherein each flow channel of the second set of flow channels is fluidically connected to a respective fluid inlet port of the second set of fluid inlet ports, wherein the forwardly facing surface portion of the die adaptor, the plurality of discharge ports, the downstream ends of the second set of flow channels, and the knife edge portion are substantially coplanar within a vertical plane;

a first pattern shim abutting the forwardly facing surface portion of the die adaptor and having a plurality of first fluid application ports defined within a first lower edge portion and a first set of through-bores, the plurality of first fluid application ports fluidically connected to respective fluid discharge ports of the die adaptor, and the first set of through-bores fluidically connected to respective downstream ends of the second set of flow channels, wherein:

the first fluid application ports of the plurality of first fluid application ports receive the first hot melt adhesive material from respective fluid discharge ports and apply the first hot melt adhesive material onto the underlying substrate in respective first material deposition patterns to form the first material pattern, and the through-bores of the first set of through-bores receive the second hot melt adhesive material from respective downstream ends of the second set of flow channels and allow passage of the second hot melt adhesive material through the first pattern shim;

a separation shim abutting the first pattern shim and having a second set of through-bores fluidically connected to respective through-bores of the first set of through-bores, the separation shim formed having a predetermined thickness and an intermediate lower edge portion, wherein the through-bores of the second set of through-bores receive the second hot melt adhesive material from respective through-bores of the first set of through-bores and allow passage of the second hot melt adhesive material through the separation shim;

a second pattern shim abutting the separation shim and having a third set of through-bores fluidically connected to respective through-bores of the second set of through-bores, and a plurality of second fluid application ports defined within a second lower edge portion, wherein:

the through-bores of the third set of through-bores receive the second hot melt adhesive material from respective through-bores of the second set of through bores and allow passage of the second hot melt adhesive material through the second pattern shim, and the second fluid application ports of the plurality of second fluid application ports apply the second hot melt adhesive material onto the underlying substrate in respective second material deposition patterns to form the second material pattern; and a die plate having a rearwardly facing surface portion abutting the second pattern shim, the die plate comprising:

a plurality of die plate flow channels defined upon or within the rearwardly facing surface portion, the die plate flow channels of the plurality of die plate flow channels having, respectively, an upstream end portion fluidically connected to respective through-bores of the third set of through-bores, the upstream end portions receiving the second hot melt adhesive material from the respective through-bores of the third set of through-bores; and a plurality of die plate fluid discharge ports defined within the rearwardly facing surface portion through which the second hot melt adhesive material is discharged, wherein each die plate fluid discharge port is fluidically connected to a respective die plate flow channel of the plurality of die plate flow channels, wherein the die plate fluid discharge ports are fluidically connected to respective second fluid application ports of the plurality of second fluid application ports and the second fluid application ports receive the second hot melt adhesive material from respective die plate fluid discharge ports, wherein the die adapter, the first pattern shim, the separation shim, the second pattern shim and the die plate are arranged in series and fixedly secured together with a plurality of fasteners, wherein the predetermined thickness of the separation shim spaces the first pattern shim from the second pattern shim by distance sufficient to apply the first hot melt adhesive material and the second hot melt adhesive material in an overlapping, and not commingling, manner with respect to one another, wherein the plurality of first fluid application ports are disposed on the first pattern shim along a width direction and the plurality of second fluid application ports are disposed on the second pattern shim along the width direction, wherein a first application port of the plurality of first fluid application ports and a second application port of the plurality of second fluid application ports are positioned relative to one another such that each of the first application port and the second application port have a portion which overlaps with the other in the width direction, and another portion that is offset from the other in the width direction, and wherein the first hot melt adhesive material is a different material than the second hot melt adhesive material.

14. The dual pattern shim assembly as set forth in claim 13, wherein:

the knife edge portion of the die adaptor is provided for defining the deposition of the first and second material patterns onto the underlying substrate without the first and second material patterns disturbing and adversely affecting each other.

15. The dual pattern shim assembly as set forth in claim 13, wherein:

the first and second pattern shims are disposed upon the same side of the knife edge portion of the die adaptor.

16. The dual pattern shim assembly as set forth in claim 13, wherein:

the die plate is disposed upon a first side of the second pattern shim while the separation shim is disposed upon a second opposite side of the second pattern shim.

17. The dual pattern shim assembly as set forth in claim 13, wherein:

a leading edge portion of the second material pattern of the second hot melt adhesive material overlaps a trailing edge portion of the first material pattern of the first hot melt adhesive material.

18. The dual pattern shim assembly as set forth in claim 13, wherein:

a leading edge portion of the first material pattern of the first hot melt adhesive material overlaps a trailing edge portion of the second material pattern of the second hot melt adhesive material.

19. The dual pattern shim assembly as set forth in claim 13, wherein the separation shim has a thickness greater than a thickness of the first pattern shim.

* * * * *